US008287363B2

(12) United States Patent
White

(10) Patent No.: US 8,287,363 B2
(45) Date of Patent: Oct. 16, 2012

(54) METHOD AND APPARATUS FOR A WAGERING GAME WITH INDICIA DEVELOPED PAYLINES

(75) Inventor: Michael L. White, Glenview, IL (US)

(73) Assignee: Primo Innovo, LLC, Glenview, IL (US)

( * ) Notice: Subject to any disclaimer, the term of this patent is extended or adjusted under 35 U.S.C. 154(b) by 972 days.

(21) Appl. No.: 12/221,909

(22) Filed: Aug. 7, 2008

(65) Prior Publication Data

US 2011/0281640 A1 Nov. 17, 2011

(51) Int. Cl.
*A63F 9/24* (2006.01)

(52) U.S. Cl. ..... 463/25; 463/16

(58) Field of Classification Search ..... 463/16
See application file for complete search history.

(56) References Cited

U.S. PATENT DOCUMENTS

| | | | | |
|---|---|---|---|---|
| 5,611,535 | A | 3/1997 | Tiberio | |
| 5,931,467 | A * | 8/1999 | Kamille | 273/139 |
| 6,089,977 | A * | 7/2000 | Bennett | 463/20 |
| 6,200,217 | B1 | 3/2001 | Osawa | |
| 6,241,607 | B1 | 6/2001 | Payne | |
| 6,261,178 | B1 | 7/2001 | Bennett | |
| 6,290,600 | B1 * | 9/2001 | Glasson | 463/20 |
| 6,428,412 | B1 | 8/2002 | Anderson | |
| 6,561,900 | B1 * | 5/2003 | Baerlocher et al. | 463/20 |
| 6,572,472 | B1 | 6/2003 | Glavich | |
| 6,604,999 | B2 | 8/2003 | Ainsworth | |
| 6,896,615 | B2 | 5/2005 | Berman | |
| 7,252,589 | B1 | 8/2007 | Marks | |
| 7,419,431 | B2 * | 9/2008 | Gauselmann et al. | 463/30 |
| 7,431,645 | B2 | 10/2008 | Han | |
| 7,674,176 | B2 | 3/2010 | Berman | |
| 2003/0013518 | A1 | 1/2003 | Graham | |
| 2003/0190948 | A1 * | 10/2003 | Baerlocher et al. | 463/20 |
| 2004/0137981 | A1 | 7/2004 | Gauselmann | |
| 2004/0166929 | A1 * | 8/2004 | Tarantino | 463/22 |
| 2005/0208994 | A1 | 9/2005 | Berman | |
| 2005/0255903 | A1 * | 11/2005 | Jackson | 463/16 |
| 2007/0026923 | A1 | 2/2007 | Muir | |
| 2007/0032291 | A1 | 2/2007 | Marks | |
| 2008/0045321 | A1 | 2/2008 | Kato | |
| 2008/0176620 | A1 | 7/2008 | Berman | |
| 2009/0156295 | A1 | 6/2009 | Demsetz | |
| 2010/0075741 | A1 | 3/2010 | Aoki | |

FOREIGN PATENT DOCUMENTS

| | | | |
|---|---|---|---|
| WO | WO 01/71678 | A1 | 9/2001 |
| WO | WO 2005/058444 | A1 | 6/2005 |

* cited by examiner

*Primary Examiner* — Tramar Harper
(74) *Attorney, Agent, or Firm* — Michael L. White

(57) ABSTRACT

In contrast to slot-type gaming machines with their preset paylines designating predetermined array positions, the paylines of this novel wagering game are unknown until the indicia in the array have been selected. The randomly selected indicia determine the paylines, if any, in the array of indicia. Conditions may be imposed that limit the size and geometry of the paylines in this wagering game.

Each indicium in the array, in one embodiment, may have an indicator for determining a subset of indicia in the array. In one embodiment, a winning game outcome occurs when the subset of indicia: 1) forms a payline, and 2) the combination of indicia designated by the payline meet predetermined requirements.

20 Claims, 12 Drawing Sheets

600

| PAY TABLE | |
|---|---|
| WINNING SYMBOL COMBINATIONS ANY INDICIA ORIENTATION 610 | INDICIA PAYLINE PAYS 620 |
|  | 10 |
|  | 10 |
|  | 5 |
|  | 3 |
|  | 5 |
|  | 2 |
|  | 1 |

1000

| PAY TABLE | | | |
|---|---|---|---|
| WINNING SYMBOL COMBINATIONS 1010 | INDICIA PAYLINE PAYS 1020 | PRESET PAYLINE PAYS 1030 | |
| | | SAME ANGLE 1032 | DIFFERENT ANGLES 1034 |
| | 5 | 3 | 1 |
| | 10 | N/A | N/A |
| | 5 | N/A | N/A |
| | 3 | 5 | 2 |
| | 5 | N/A | N/A |
| | 2 | 5 | 3 |
| | 1 | 5 | N/A |
| | N/A | 10 | N/A |

*FIG. 10*

METHOD AND APPARATUS FOR A WAGERING GAME WITH INDICIA DEVELOPED PAYLINES

FIELD OF THE INVENTION

This invention relates to gaming, and more particularly, in one embodiment, to wagering games played on video gaming machines.

BACKGROUND OF THE INVENTION

Gaming machines are a popular form of entertainment with gaming establishment patrons. Slot type gaming machines form an array of randomly selected indicia. These games traditionally use preset paylines to indicate predetermined array positions, which, if filled with winning combinations of indicia, provide a winning game outcome.

SUMMARY OF THE INVENTION

A wagering game with an array of randomly selected indicia is presented to the player after a wager is placed. Each indicium, in one embodiment, may have zero, one, or a plurality of members. These members may link indicia, indicating a subset of indicia in the array.

For example, in one embodiment, when the member of one indicium is in alignment with the member of another indicium, a link is formed between those indicia. A plurality of indicia may be linked together to form a payline. A winning game outcome occurs when the indicia forming the payline satisfies predetermined requirements.

BRIEF DESCRIPTION OF THE FIGURES

Various embodiments of the wagering game are described and illustrated in the accompanying figures. The figures are provided as examples only and are not intended to be considered as limitations to the invention. Similarly, numerical entries only represent exemplary information, and those skilled in the art understand that a variety of different values and alternate arrangements can be made. Consequently, the wagering game is illustrated by way of example and not by limitation in the accompanying figures in which:

FIG. 10 is an exemplary pay table for the exemplary wagering game embodiment of FIG. 9;

DETAILED DESCRIPTION

The wagering game described in the following embodiments may be adapted for play on gaming machines similar to those commonly found in gaming establishments. Gaming establishments commonly network gaming machines into a gaming system that facilitates the monitoring and support of each gaming machine in the system.

Figure 1:
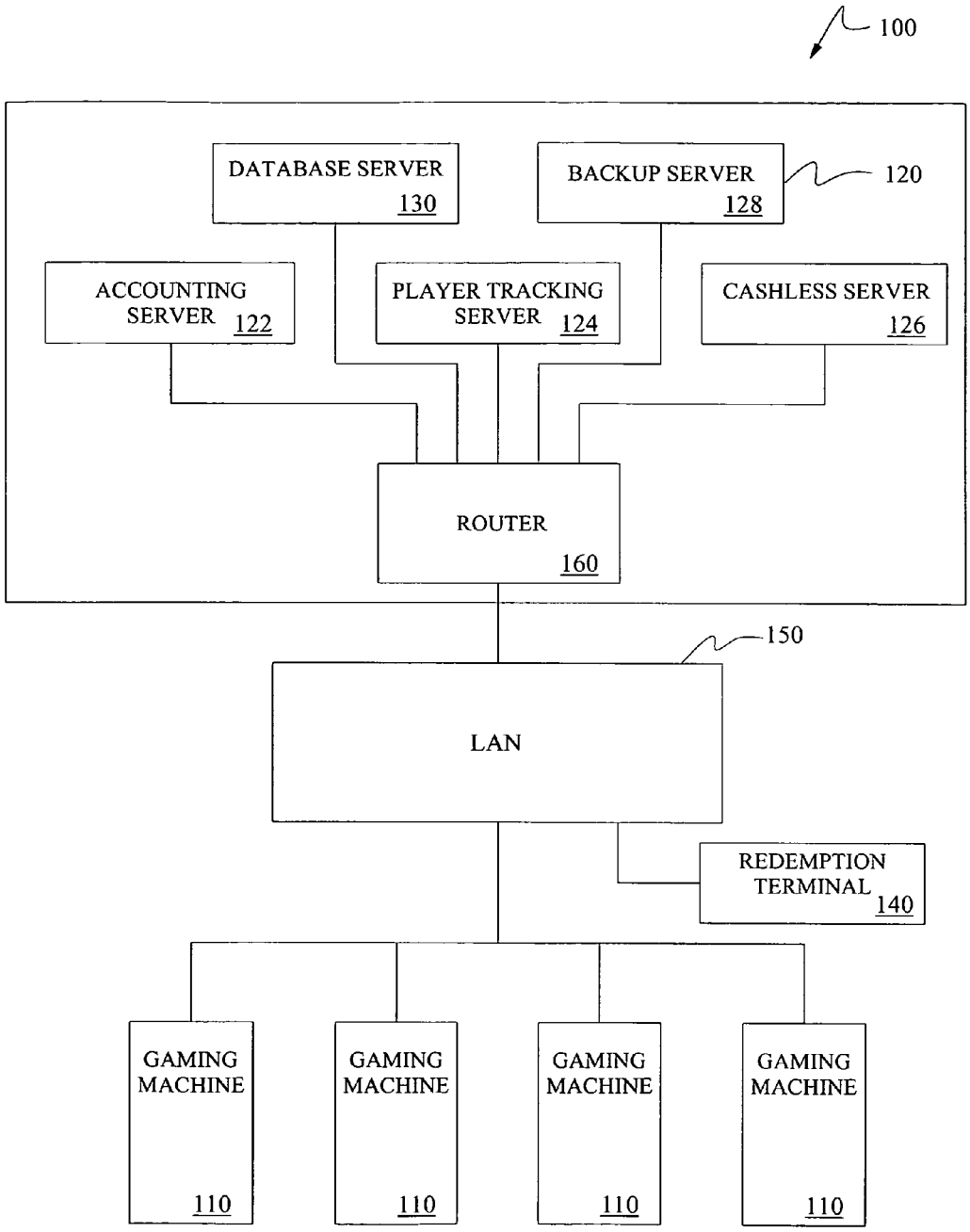
FIG. 1 is an exemplary block diagram of a gaming system.

Referring to FIG. 1, an exemplary gaming system 100 typically found in a gaming establishment is illustrated. Gaming machines 110 on the floor of a gaming establishment are usually in communication with a number of servers 120 that provide ancillary support services for wagering activity at each gaming machine. These servers 120, and the gaming machines 110 they communicate with, are connected in a communications network (e.g., a local area network (LAN) 150 electronically linking the gaming system 100 together. Other network devices such as routers 160, storage devices (e.g., a database server 130), and backup servers 128 may also be part of the gaming system 100. Although it is common practice to use several different servers, each dedicated to particular gaming functions, it is also possible to bundle these different gaming functions for execution on a single server.

Servers 120 commonly found in some gaming systems include: an accounting server 122 (to record wagers and payouts), a player-tracking server 124 (to track wagering activity of individual players), and a cashless server 126 (to assist with the issue and redemption of wagering vouchers).

The player-tracking server maintains a record of the player's wagering activity, allowing the gaming establishment to reward gaming patrons commensurate with their wagering activity. A player-tracking card is commonly provided to gaming patrons for participation in player loyalty programs sponsored by the gaming establishment. The player tracking card is encoded with a unique player identification number that allows the player-tracking server to maintain a record of player wagering activity.

The cashless server maintains a record of issued vouchers. Vouchers are typically paper tickets with an imprinted monetary value that facilitates wagering. These vouchers are printed and accepted by gaming machines 110 to allow players to make wagers and cash out of the gaming machine. Each wagering voucher has a unique barcode identifier that acts as an index to a database for retrieving information regarding the voucher (e.g., the specific monetary value of the voucher).

Typically, the cashless server 126 stores this information in its database for recall when the voucher is presented for redemption.

When presented to a gaming machine 110, the barcode information is communicated to the cashless server 126, and the voucher is validated by the cashless server 126. The voucher value is then communicated to the gaming machine, and the value of the voucher credited for play on the gaming machine.

Other gaming devices in the gaming system 100 may be present and in communication with the local area network 150. For example, a redemption terminal 140 (e.g., such as a computer terminal for a cashier or a self serve kiosk) may be available to allow a player to cash out a voucher. This redemption terminal 140 is typically in communication with the cashless server 126 to facilitate monetary transactions.

The gaming machines 110, servers 120, and other network devices typically use serial communication protocols for transferring data over the gaming system's local area network 150. In other embodiments, gaming systems 100 may use Ethernet type communication protocols—or any other communication protocol using any number of different types of communication media (including, e.g., optical fiber, radiofrequency, etc).

Regardless of whether a single or multiple servers 120 are utilized in the gaming system 100 embodiment illustrated in FIG. 1, in most gaming systems, the gaming machine 110 determines the game outcome and the servers 120 support the wagering and data collection activities of each gaming machine. A game program (i.e., software) controls the gaming machine 110 and is executed with a CPU (i.e., central processing unit or simply processor) in the gaming machine to determine the game outcome.

In other gaming systems—in lieu of executing a game program from a CPU in the gaming machine—the execution of the game program is performed by a CPU in a game server (not shown). For example, in one embodiment, the game server may execute a game program in response to initiation of the wagering game at a gaming machine 110. In this gaming system embodiment, the game server may perform all game program calculations and transmit video data to the gaming machine for display. Player selections may be transmitted from the gaming machine to the gaming server for further execution by the game program.

Alternatively, in still another gaming system embodiment, a CPU in the gaming machine and a CPU in a game server may each execute portions of a game program. For example, the game server may be limited to determining and transmitting random numbers to the gaming machine. The gaming machine uses these random numbers to determine, either directly or indirectly, game outcomes.

The gaming machine 110 illustrated in FIG. 1 is typically either an electro-mechanical gaming machine or a video gaming machine. The electro-mechanical gaming machine has mechanical reels to display game outcomes. In contrast, the video gaming machine has a video display for displaying game outcomes. With the exception of the game presentation (i.e., either mechanical reels or a video display), both types of gaming machines operate using the same basic principles.

Video gaming machines, because of their video display, are adaptable to support many different types of wagering games including the wagering game described and claimed in this specification. The electromechanical gaming machine may also be adapted to support embodiments of this wagering game—particularly those electromechanical gaming machines using independent reels to individually display each indicium in the array.

Figure 2:
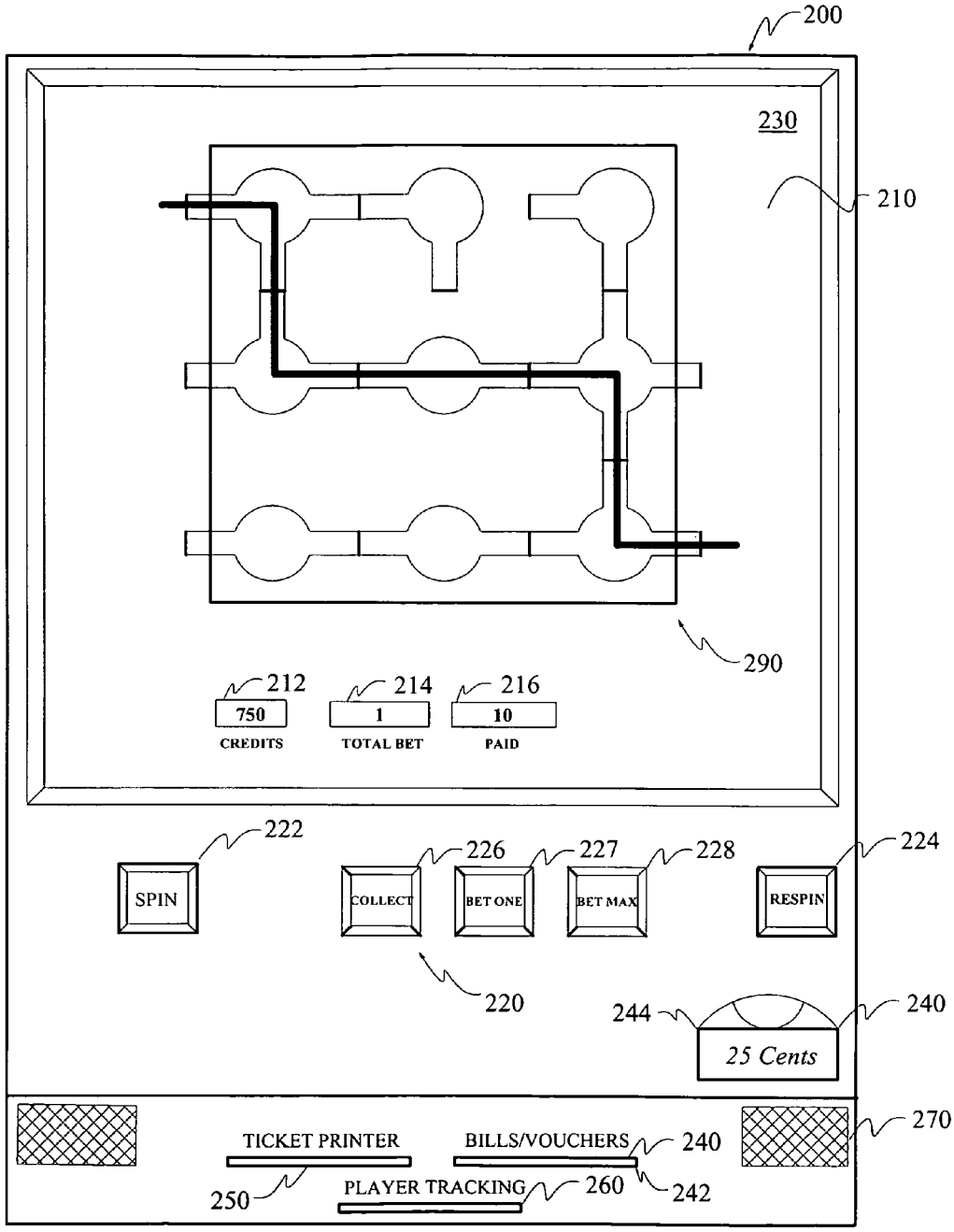
FIG. 2 is an orthogonal view of one embodiment of the gaming machine illustrated in FIG. 1.

FIG. 2 illustrates one embodiment of the gaming machine 100 depicted in FIG. 1. FIG. 2 depicts a video gaming machine 200 specifically adapted for play of the wagering game embodiments described herein. The video gaming machine 200 has a wager acceptor 240 for initiating game play. The wager acceptor 240 may be a bill validator 242 (for accepting paper currency), a coin acceptor 244, or any other device capable of receiving and registering some form of acceptable monetary value. The bill validator 242 may, in some embodiments, also accept vouchers (generally in the form of paper tickets).

As discussed above, vouchers are printed by some video gaming machines 200 in lieu of paying coins when a player cashes out of the gaming machine. The video gaming machine 200, in this embodiment, has a ticket printer 250 which prints a voucher for the value of the cash out from the gaming machine. Typically, the voucher may be redeemed by a video gaming machine 200 by inserting the voucher into the bill validator 242. The bill validator 242 reads the barcode printed on the voucher, communicates with the cashless server to determine the value of the voucher, and credits the video gaming machine 200 for the value of the voucher.

The video gaming machine 200, in some embodiments, may have an alternative or additional payout mechanism such as a coin hopper (not shown on FIG. 2) internal to the gaming machine. The coin hopper dispenses coins to the player when the player cashes out.

The video gaming machine 200 may also include a card reader 260 for reading an identification card commonly known as a player-tracking card. The card reader 260 reads the player-tracking card and communicates the player's identification number to a player-tracking server.

Game play is initiated when the video gaming machine 200 receives a wager. The wagering game 290, in one embodiment, is displayed on the video display 210 of the video gaming machine 200. The video display 210 is generally a CRT or flat-panel display such as a LED or plasma display. However, any other type of display may be used to present the wagering game 290.

The video display 210 may also have a video representation of wagering meters to provide wagering information to the player. The meter display may include: a credit meter 212 (displays total credits available for wagering), total bet meter 214 (displays the number of credits bet on each game), and a paid credit meter 216 (displays payoff credits obtained from a winning game outcome).

In some embodiments, the player may make wagering selections using a pushbutton panel 220. For example, the player may designate: the amount wagered on each individual game (e.g., the bet one pushbutton 227 and the bet max pushbutton 228), the start of the game (e.g., the game start pushbutton 222), and the collection of credits on the gaming machine (e.g., using the collect pushbutton 226).

The pushbutton panel 220 may also be used by the player to make game play decisions. For example, a respin pushbutton 224 may be available to allow the player to cause the video gaming machine 200 to randomly change the angular orientation of each indicium in its array position.

The video display 210 may operate, in some embodiments, in conjunction with a touch screen 230. To facilitate the play of a plurality of different games on a single video gaming machine 200, the touch screen 230 may serve as a means for inputting player selections. Icons representing various potential player selections may be presented on the video display 210. The player may touch an icon presented on the video display 210 to implement the corresponding function represented by the icon. In one embodiment the touch screen 230 may be used exclusively to control game play—eliminating the need for a pushbutton panel 220. In other embodiments, a combination of the pushbutton panel 220 and the touch screen 230 may be used to execute the player's game play decisions.

In addition, the video gaming machine 200 may provide sound effects or music to accompany game play through speakers 270. The speakers 270 may also provide game play information (e.g., audio help to the player).

Figure 3:
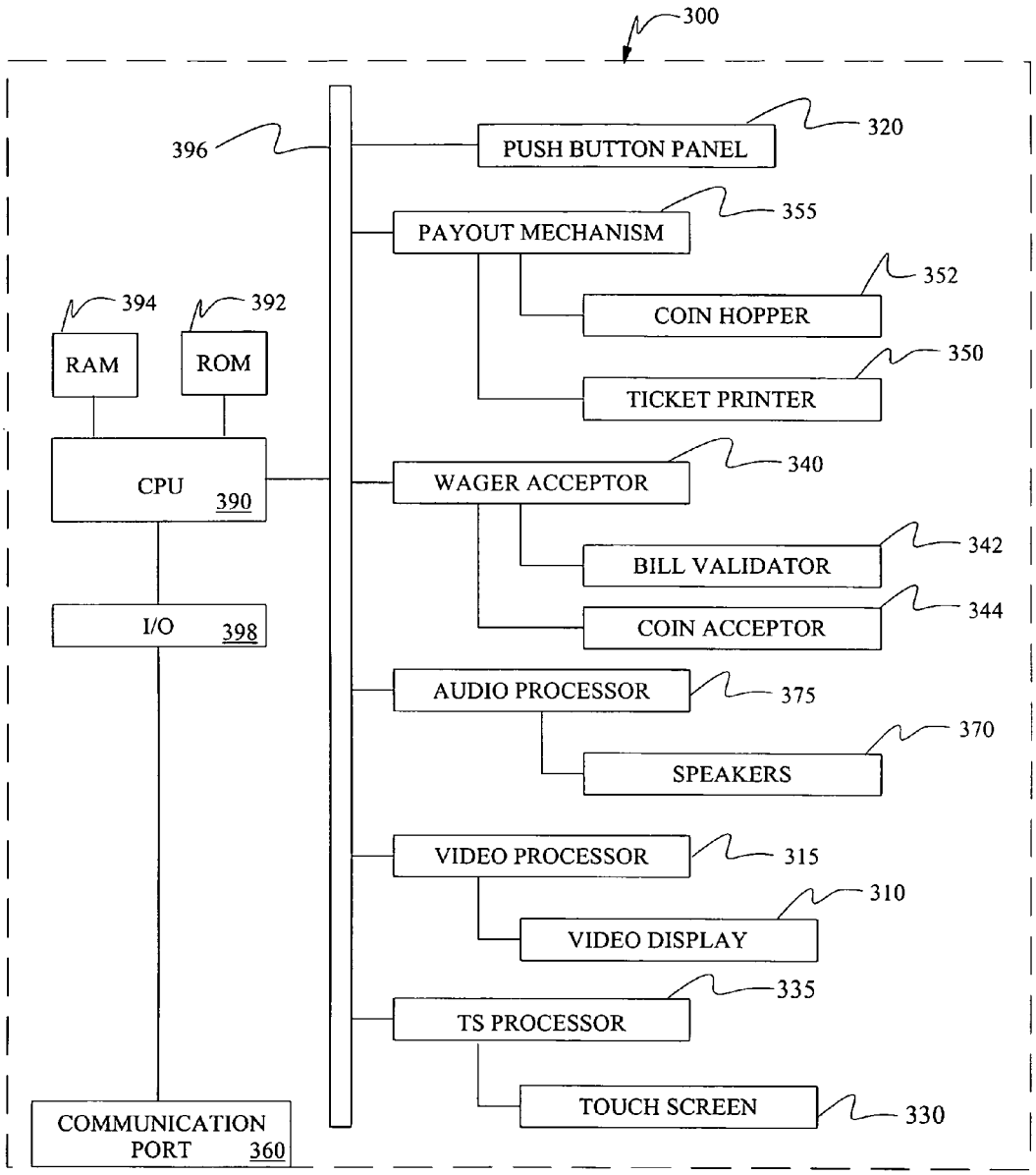
FIG. 3 is an exemplary block diagram of one embodiment of the control system of the gaming machine of FIG. 2.

With reference to FIG. 3, an exemplary control block diagram 300 is provided depicting the operational control of one embodiment of the video gaming machine 200 illustrated in FIG. 2. The central processing unit (i.e., CPU) 390, among other functions, controls the operation of peripheral devices ancillary to the operation of the gaming machine through the execution of the game program.

The CPU 390 has an internal I/O bus 396 to control communications between the CPU and the peripheral devices. The CPU 390 generally controls, either directly or indirectly: the bill validator 342 and coin acceptor 344 (more generally known as wager acceptors 340), the video display 310 (output controlled by video processor 315), the pushbutton panel 320, the coin hopper 352 and ticket printer 350 (more generally known as payout mechanisms 355), speakers 370 (output controlled by audio processor 375), and the touch screen 330 (input monitored by touch screen processor 335).

The CPU 390 not only controls and communicates with peripheral devices inside the gaming machine, but is also in communication with various servers that provide ancillary support services through a communication network as previously discussed. Typically, the CPU 390 also has a second, external I/O bus 398 that exchanges data with the communication network through communication port 360 in the gaming machine.

In addition to controlling each of the gaming machine's peripheral devices, the CPU 390, through the execution of the game program, also controls game play. The gaming machine has both non-volatile read-only memory (ROM) 392 in which the game program is stored and volatile random access memory (RAM) 394 from which the game program is executed by the CPU 390.

The game play displayed by the gaming machine is typically determined by the CPU. In one embodiment, the CPU 390 randomly selects indicia from an indicia set by generating a random number with a random number generator (not shown). In one embodiment, the random number generator (RNG) employs a mathematical formula to determine a random number.

In one embodiment, the random number determined is within a predetermined numerical range and corresponds to a game outcome listed in a probability table stored in memory. This random number represents the entry point to the probability table for determining the indicia displayed on the gaming machine. The probability table determines the probability of occurrence of any game outcome by associating each of the random numbers in a given range with a game outcome. The probability table may be weighted to achieve a desired game outcome distribution over a large number of game outcomes. Consequently, some game outcomes will be associated with more random numbers than other game outcomes.

In another embodiment, a separate random number is generated to determine each indicium. In this embodiment, a random number for each array position is generated to determine each indicium in the game array.

Once the indicia have been selected, the indicia are displayed to the player on the video display. More specifically, the CPU 390 in the video gaming machine signals the video processor 315 to display the game outcome on the video display 310.

With a general understanding of gaming machine operation, the wagering game executed by the game program may be described in further detail. In one embodiment, the wagering game may be broadly described as a slot type wagering game with indicia developed paylines. In this embodiment, an indicium is differentiated from other indicia by the number of links that can potentially be made with adjacent indicia. Each indicium in the array has an initial angular orientation, randomly selected, that may potentially link it to an adjacent indicium. Several indicia may link together forming a continuous linking of indicia (i.e., linking indicia). These linking indicia may form a payline, and dependent upon the indicia designated by the payline (i.e., on the payline), a winning indicia combination may be formed. This wagering game is described in more detail below in conjunction with the process flowchart 400 of FIG. 4.

Figure 4:
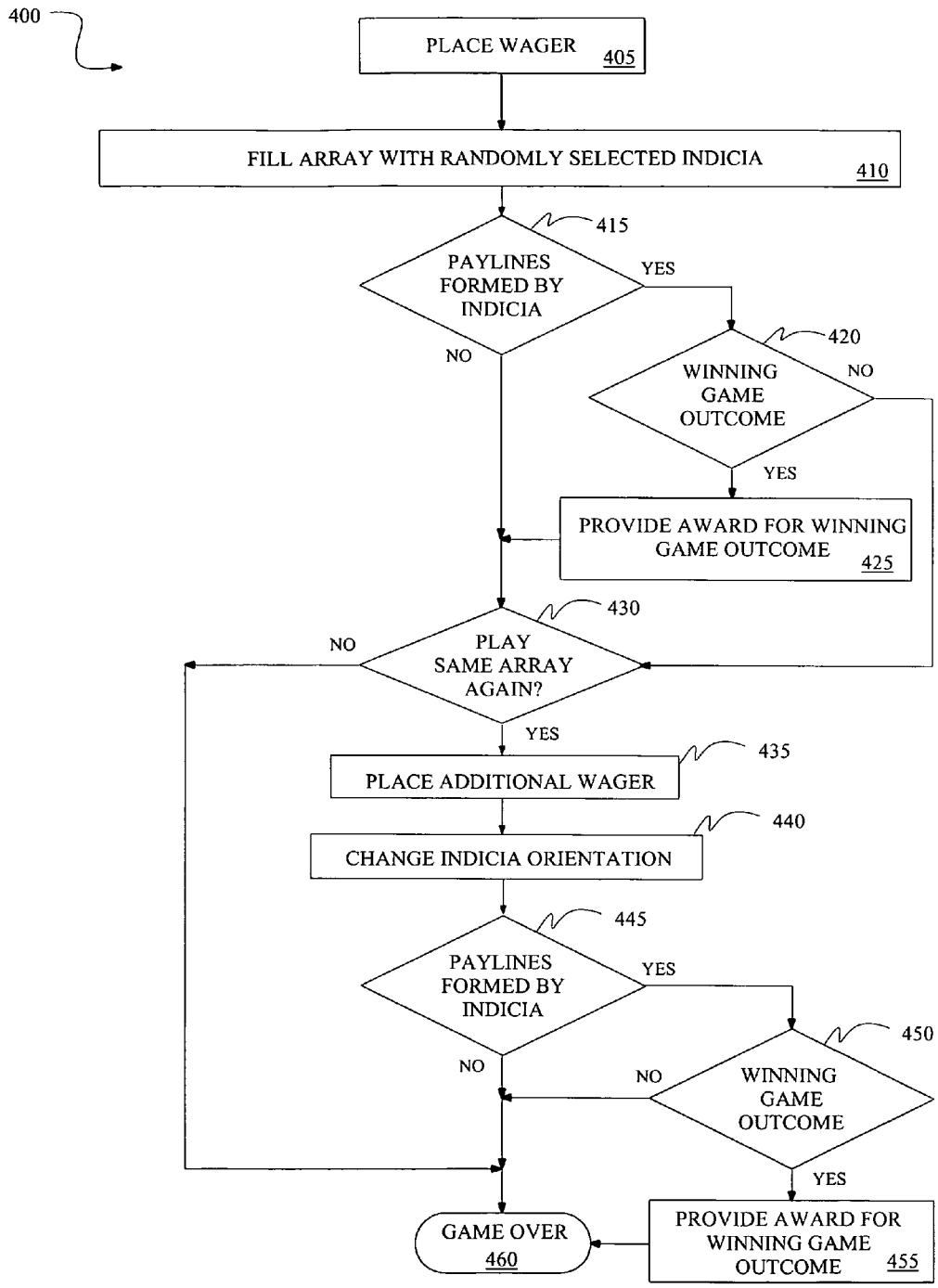
FIG. 4 is an exemplary process flowchart illustrating the game play of one embodiment of the wagering game.

Referring to FIG. 4, the process flowchart 400 provides an overview of the wagering game process. As is generally the case in most slot type gaming machines, the wagering game starts with a wager in step 405. The gaming machine then forms an array with randomly selected indicia in step 410.

The gaming machine determines in step 415 whether the randomly selected indicia in the array form paylines. As previously noted, in one embodiment, paylines are formed by indicia linking together which meet one or more payline construction conditions.

In another embodiment, the mere linkage of indicia creates a subset of indicia potentially eligible for an award. In this embodiment, no conditions are required to be met (aside from the linkage of indicia).

For embodiments of the wagering game that do require paylines, the identification of indicia developed pay lines may be done in a number of different ways. One approach for identifying paylines in the array is to first search the array for linking indicia, and then determine if the linking indicia meet the conditions requisite for forming a payline.

The formation of pay lines may be limited, in one embodiment, based on conditions specified by the wagering game for defining the geometry of valid paylines. For example, conditions may limit the array positions available for forming the payline. In other embodiments, conditions may exist that limit the indicia available for forming the payline. Consequently, the exact methodology used to identify pay lines is dependent on the conditions imposed by the wagering game for the formation of paylines.

For example, as noted above, it may be a requirement that all pay lines enter and exit from the left and right sides of the array. For example, in a 3×3 array, each of the array positions comprising the first column must be individually analyzed for the presence of an indicium with a left extending member that creates an entry point into the array—a necessary condition for the development of a payline.

For those array positions in the first column having an indicium with a left extending member, adjacent array positions to which the first column indicium potentially links must be analyzed for a potential link with an adjacent indicium. Each possible subsequent branch of the payline must be investigated in the same manner to determine if a payline can be made to extend across to an array position in the third column of the array. If the payline does extend across to the third column of the array, the indicium in that third column array position must have a right extending member to exit the array per the conditions imposed for payline construction.

If a payline is formed, the indicia designated by the payline are evaluated for winning indicia combinations in step 420. In one embodiment, winning game outcomes require specific combinations of indicia which are typically listed in a pay table. In some embodiments, winning game outcomes may also require a specified sequence of indicia. The award for such a winning indicia combination may then be determined from a pay table in step 425.

Regardless of the formation of a payline in step 415, in this embodiment, the player is given the opportunity to respin the same array with the same indicia in step 430. Respinning changes the angular orientation of an indicium while maintaining its original array position. In some embodiments, the respin may be applied to all indicia in the array or, in other embodiments, to less than all the indicia. The player, the machine, or both the player and the machine may determine the specific indicia to respin. The respin process provides the potential for indicia to form new connections with other indicia and consequently, the potential for forming new paylines with winning game outcomes.

In this embodiment, the only difference in the array as a result of the respin—should the player opt to replay the same array—is that the angular orientation of each indicium in its original array position is changed. Should the player decide not to play the same array again in step 430, the game is over in step 460.

In order to respin the array, in one embodiment, the player must place an additional wager in step 435. This additional wager helps to offset the player's advantage knowing the indicia in the array and the likelihood of a winning game outcome occurring with the respin. In another embodiment, the player may be allowed to make additional wagers until a winning game outcome is achieved from the respin. In still another embodiment, the additional wager in step 435 may be waived if no paylines were originally formed in the array.

Consequently, in this embodiment, the player is given the opportunity to strategically weigh the probability of the array producing additional winning game outcomes from the respin before placing an additional wager. The appeal of the respin feature is that the player can selectively wager on those gaming arrays having the greatest potential for producing winning game outcomes. Consequently, the player may be limited to only one respin of the array to maintain the payback percentage of the game at a determinable level.

In step 440, the angular orientation of each of the indicia in the array is randomly changed. In step 445, the respun array is evaluated to identify new paylines formed by the angular reorientation of the indicia. If a payline is formed, the indicia on the payline are evaluated to determine whether those indicia form a winning game outcome in step 450. If winning indicia combinations are found, an award is provided for the winning game outcome in step 455 and the game is then over in step 460. If paylines are not formed in step 445, the game is over in step 460.

The embodiment described by the process flowchart of FIG. 4 is but one embodiment of the wagering game. Other embodiments include, for example, the same process described in FIG. 4 without the option of respinning the array as provided in step 430. Instead, the game is over after step 425 and a new game can then be commenced with an entirely new array of randomly selected indicia.

Figure 5A:
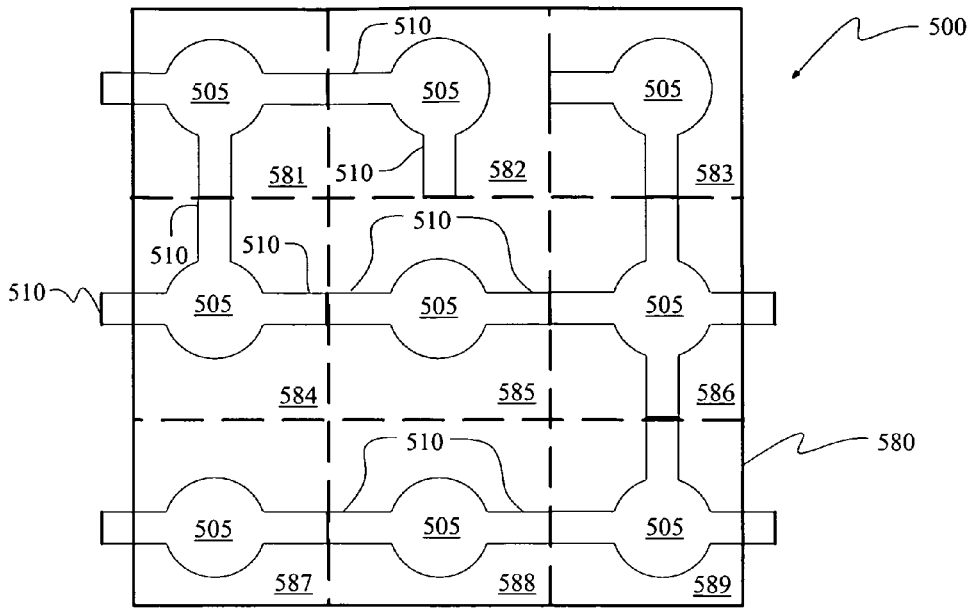
FIG. 5A is an exemplary game outcome of one embodiment of the wagering game.

Turning to FIG. 5A through FIG. 5F, an exemplary wagering game 500 progressively illustrates the paylines developed by the indicia. This wagering game 500 generally follows the game play process depicted by flowchart 400 of FIG. 4. Referring to FIG. 5A, the wagering game 500 is depicted with a random selection of indicia 505 in a plurality of array positions 581 through 589 in an array 580.

Each indicium in this embodiment can be grouped with other like indicium on the basis of: 1) the number of members 510 associated with an indicium, and 2) the relative angular position of the indicium's members. For example, the indicium in array position 585 has two members 510. Likewise the indicium in array position 582 also has two members. However, the indicium in array position 582 has a 90° angle between its two members 510; in contrast to the indicium in array position 585 which has a 180° angle between its two members. In other embodiments, only the number of members 510 determines like indicia.

As noted above, in one embodiment, the member is part of—and determines—the overall identity of the indicium 505. In this embodiment, the indicia are distinguished by the number of members and the member's relative angular relationship on each indicium. Winning indicia combinations are determined by the type of indicia designated by the payline. In this embodiment, the linking of indicia requires a member from each of two indicia to cooperatively indicate a link; in this case by appropriately aligning the members between the indicia.

In the embodiment illustrated in FIG. 5, paylines may be formed by the continuous linking of indicia (i.e., indicia linking together) horizontally across the array. For example, paylines extending from left to right in the array may travel vertically in a column with appropriately aligned members connecting indicia until further appropriately aligned members connecting indicia extending horizontally can continue travel of the payline. In addition, paylines may be formed by the continuous linking of indicia extending vertically across the array—and similarly, may use a plurality of indicia in a row to make this continuous connection.

It is a further condition of this embodiment of the wagering game 500 that the payline must enter and exit the array 580. The entry and exit from the array 580 is indicated by the same member 510 associated with certain indicia 505 used to indicate at least a partial linking connection with adjacent indicia. Only a single member 510 from an indicium 505 is required to indicate entry or exit from the array 580. For example, in array position 584, a member 510 associated with an indicium 505 extends to the left entering/exiting the array 580.

Figure 5B:
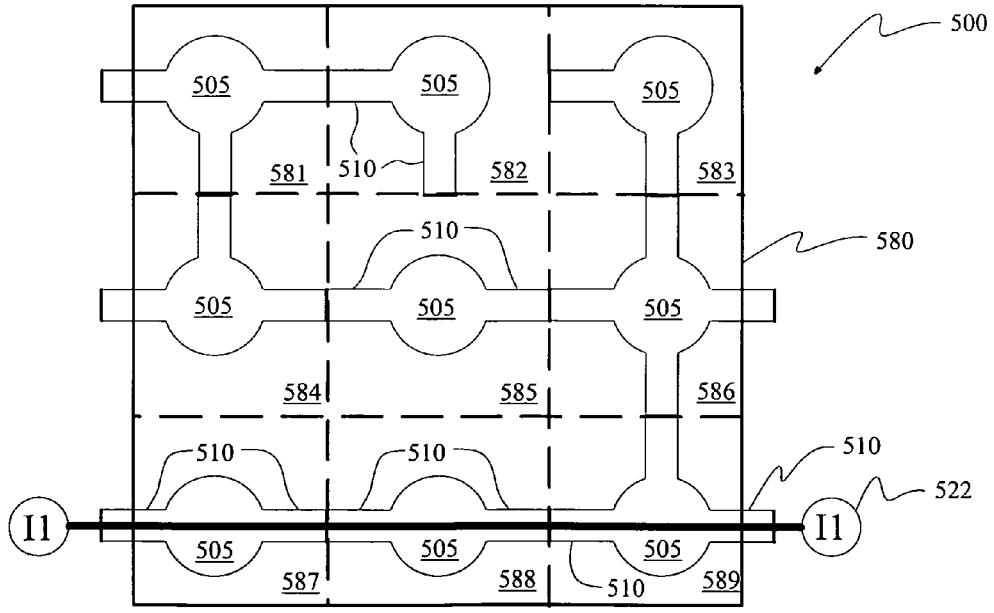
FIG. 5B is the exemplary game outcome of FIG. 5A illustrating a first indicia developed payline.

Turning to FIG. 5B and applying the above described payline construction conditions, the wagering game 500 has identified a first indicia developed payline 522 created by the indicia 505 in array positions 587, 588, and 589 (linking indicia). In accordance with the payline construction conditions, indicium 505 in array position 587 has a member 510 entering the array 580. Similarly, the indicia 505 in array position 589 has a member 510 exiting the array 580. Furthermore, the members 510 link together the indicia 505 in array positions 587, 588, and 589 to form a subset of indicia. Consequently, the payline 522 in FIG. 5B may receive an award if the indicia designated by the payline form a winning indicia combination.

Figure 5C:
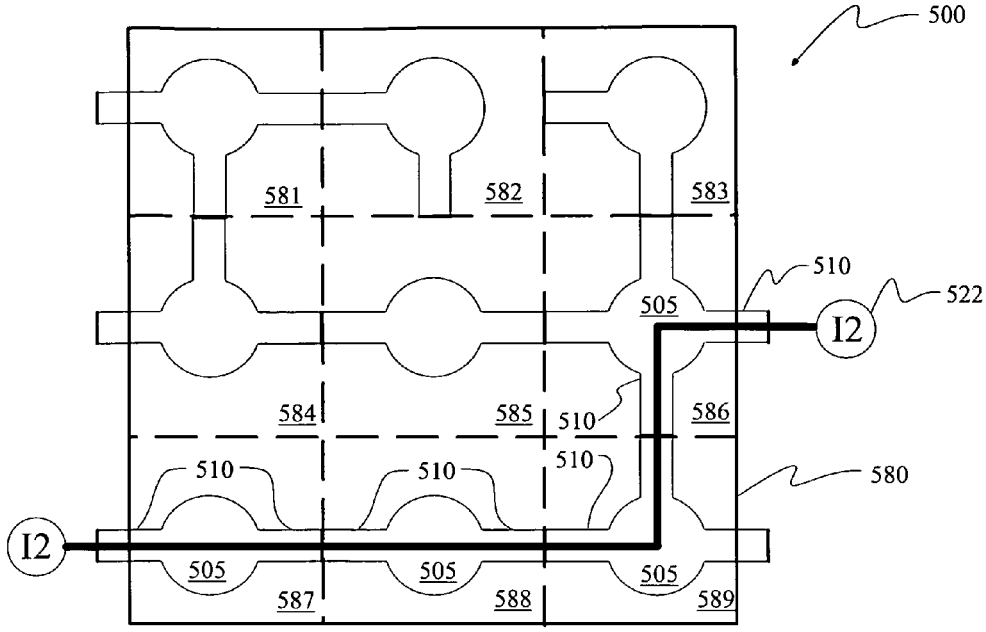
FIG. 5C is the exemplary game outcome of FIG. 5A illustrating a second indicia developed payline.

Turning to FIG. 5C, another payline 522 has been identified by the wagering game 500 developed by indicia 505 in array positions 587, 588, 589, and 586 (linking indicia). Again, each of the indicia 505 in array positions 587 and 586 have members 510 indicating an entry and exit point for the payline 522 from the array 580. Furthermore, the members 510 link together the indicia 505 in array positions 587, 588, 589, and 586 to form a subset of indicia. Consequently the payline 522 in FIG. 5C may receive an award if the indicia designated by the payline forms a winning indicia combination.

Figure 5D:
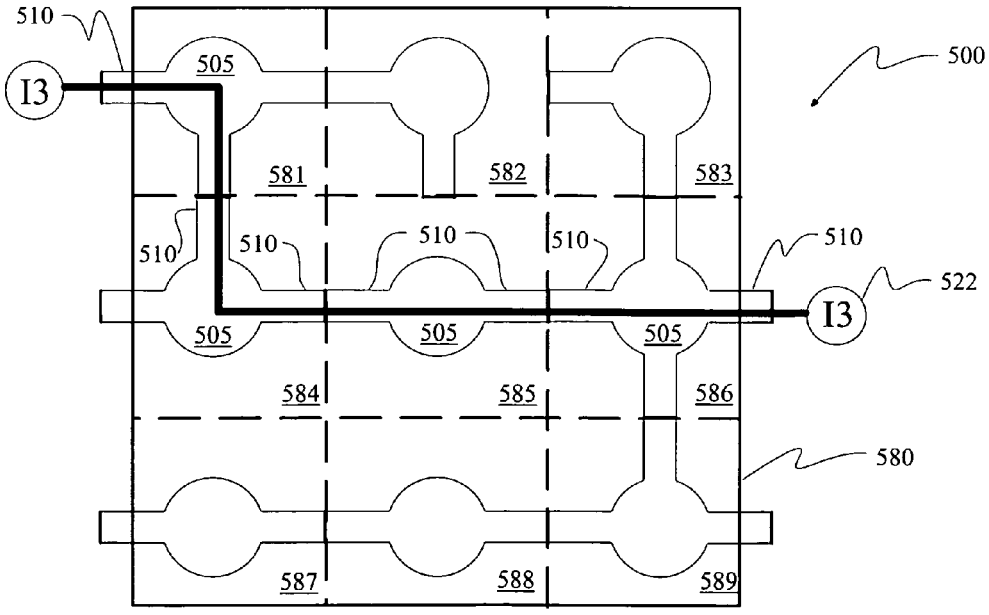
FIG. 5D is the exemplary game outcome of FIG. 5A illustrating a third indicia developed payline.

Turning to FIG. 5D, another payline 522 has been identified by the wagering game 500 created by indicia 505 in array positions 581, 584, 585, and 586 (linking indicia). Indicia 505 in array positions 581 and 586 have members aligned to provide an entry and exit point for payline 522 from the array 580. Furthermore, the members 510 link together the indicia 505 in array positions 581, 584, 585, and 586 to form a subset of indicia. Consequently the payline 522 in FIG. 5D may receive an award if the indicia designated by the payline forms a winning indicia combination.

Figure 5E:
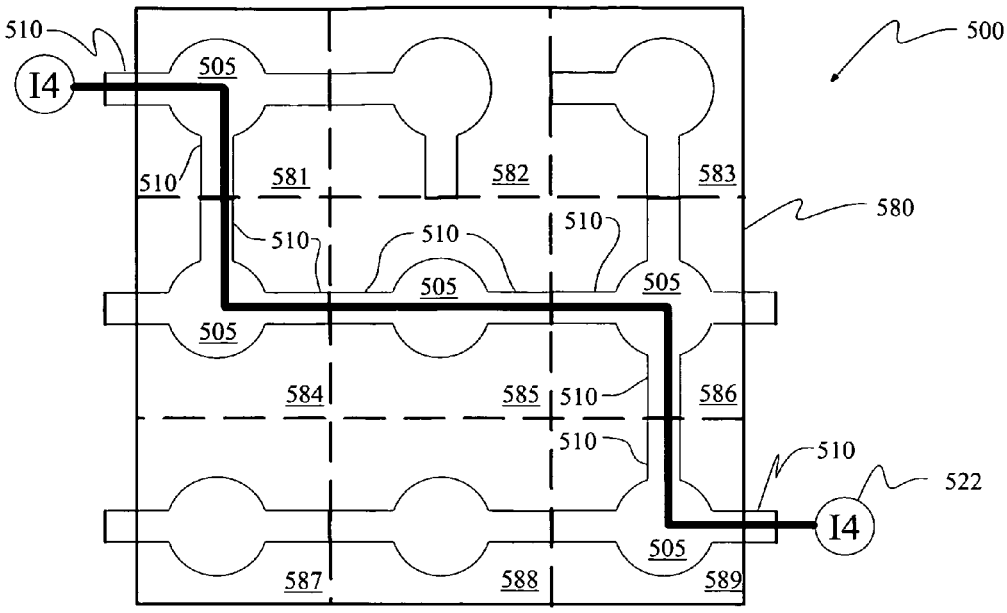
FIG. 5E is the exemplary game outcome of FIG. 5A illustrating a fourth indicia developed payline.

Turning to FIG. 5E, another payline 522 has been identified by the wagering game 500 developed by indicia 505 in array positions 581, 584, 585, 586, and 589 (linking indicia). Again, indicia 505 in array positions 581 and 589 have members 510 aligned to provide an entry and exit point from the array 580. Furthermore, the members 510 link together the indicia 505 in array positions 581, 584, 585, 586 and 589 to form a subset of indicia. Consequently the payline 522 in FIG. 5E may receive an award if the indicia designated by the payline forms a winning indicia combination.

Once the paylines have been identified (as shown in FIG. 5B-FIG. 5E), each individual pay line can be assessed for a winning game outcome. The wagering game 500 illustrated in FIG. 5 has four different indicia developed paylines 522. Each of these indicia developed paylines 522 is potentially eligible for an award based on the indicia 505 designated by the payline. Indicia combinations forming a winning game outcome and the award associated with that winning game outcome is generally contained in a pay table for the wagering game.

Figure 5F:
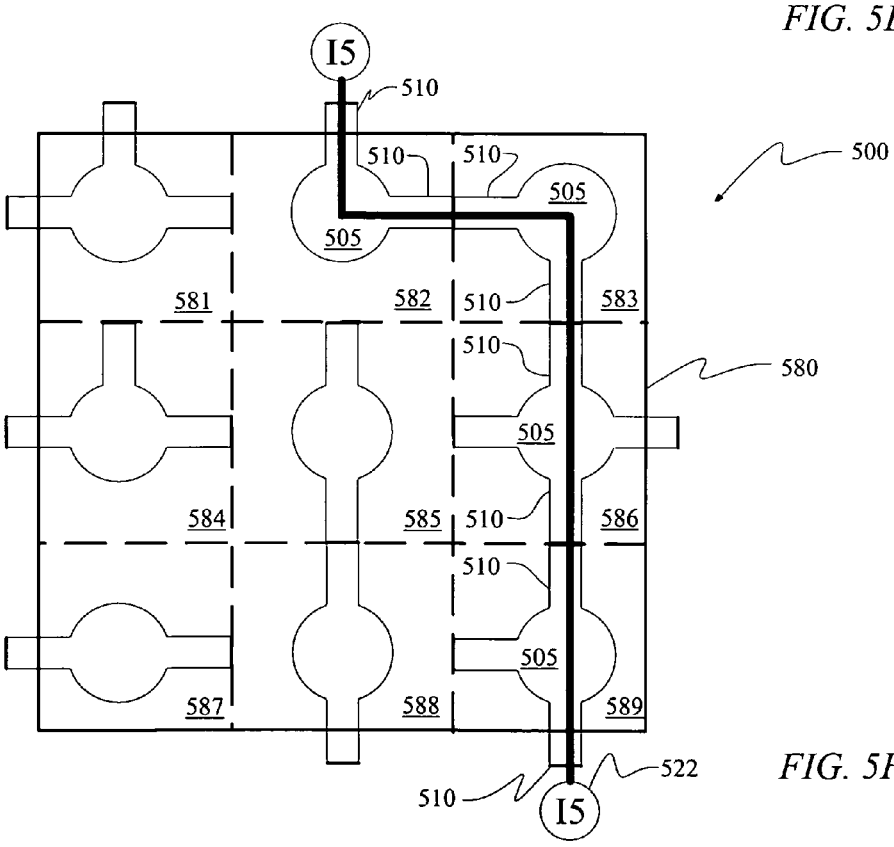
FIG. 5F is an exemplary game outcome received from the random angular reorientation of the indicia in the array depicted in FIG. 5A.
Figure 6:
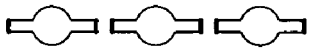
FIG. 6 is an exemplary pay table for the exemplary wagering game embodiment of FIG. 5.
Figure 6:
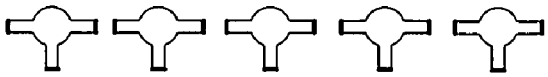
Figure 6:
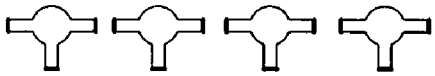
Figure 6:
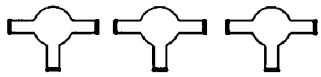
Figure 6:
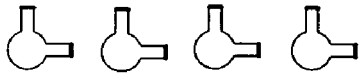
Figure 6:
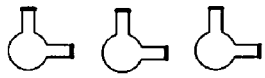
Figure 6:
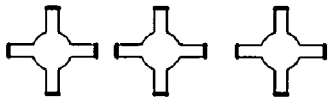

Referring to FIG. 6, an exemplary pay table 600 for the wagering game 500 embodiment illustrated in FIG. 5 is provided. The pay table 600 of FIG. 6 makes an award 620 based on the winning indicia combination 610 formed by the indicia on the payline—irrespective of the position of indicia on that payline in this embodiment.

For the wagering game 500 embodiment exemplified by FIG. 5, by inspection, the longest possible payline that could be created in this wagering game 500 is a link of five indicia exemplified by the illustration of FIG. 5E (i.e., reversing payline direction is not permitted); the shortest payline is a link of three indicia exemplified by the illustration of FIG. 5B. Consequently, a winning game outcome could potentially include anywhere from three to five of the same indicia.

Consequently, as can be seen from the pay table 600, winning indicia combinations are listed having up to five identical indicia. A minimum of three identical indicia are required to achieve a winning game outcome. These identical indicia may occur on the payline in any order. It should be noted, in this embodiment, the angular orientation of the indicia is irrelevant to the determination of a winning game outcome and to any possible award. The orientation of the indicia is only relevant to the creation of paylines in this embodiment.

This type of winning game outcome is similar to a "scatter" pay reminiscence of a traditional slot type game. In another embodiment, if desired, three consecutively positioned indicia may pay more then three indicia that are not consecutively positioned from left to right on the pay line. Furthermore, in still another embodiment, a winning game outcome having indicia with the same angular orientation may provide a larger award than the same number of identical indicia having different angular orientations.

Applying this pay table 600 to the exemplary wagering game 500 embodiment illustrated in FIG. 5, it is apparent that the only winning game outcome occurs on the payline 522 shown in FIG. 5E. The indicia developed payline 522 designates five array positions, with three array positions having identical three-member indicia occurring in array positions 581, 584, and 589. Although these indicia do not occur consecutively across the payline, they are eligible for an award. As can be seen from pay table 600, an award 620 of three credits is paid for this winning indicia combination 610.

The remaining paylines depicted in FIG. 5 do not have the three or more identical indicia required for a winning game outcome. Consequently, the player has won three credits for this array.

Returning to the exemplary wagering game 500 embodiment depicted in FIG. 5 (and following the flowchart 400 embodiment illustrated in FIG. 4), the player now has the opportunity to place an additional wager to respin (randomly change the angular orientation) each indicium in its original array position. In some embodiments, the original angular orientation of an indicium may be randomly selected again—in effect, not changing the angular orientation of the indicium.

With this game play mechanic, a player is given the opportunity to strategically assess the probability of obtaining winning game outcomes from the random angular reorientation of the indicia. To assist the player in assessing the probability of success with a respin, the indicia may be colorized to help the player quickly assess the strength of the indicia in the array. For example, indicia having four members may be colored green; indicia having three members may be colored blue; indicia having two members may be colored yellow; and indicia having no members may be colored red. Respining an array having substantially all green and blue indicia would have a higher probability of producing a winning game outcome than an array substantially filled with red and yellow indicia.

In another embodiment, in lieu of respinning the indicia, the original array may be reformed by placing the original indicia into random array positions. Furthermore, the reformed array may also be respun.

Referring to FIG. 5F, the player has made the additional wager and the angular orientation of the indicia in the array has been randomized. As a result, a new indicia developed payline 522 has been created from the top to the bottom of the array 580 in array positions 582, 583, 586, and 589. This payline, however, does not contain the minimum requirement of three identical indicia, making it ineligible for an award per the pay table 600 illustrated in FIG. 6.

Although the embodiment illustrated in FIG. 5 have paylines that are similar to left to right and top to bottom paylines found in traditional slot type gaming machines, other embodiments are also available that use less traditional payline geometry. For example, in one embodiment, any path created by connecting indicia that enters and exits the array may be considered a payline and potentially eligible for an award.

Figure 7:
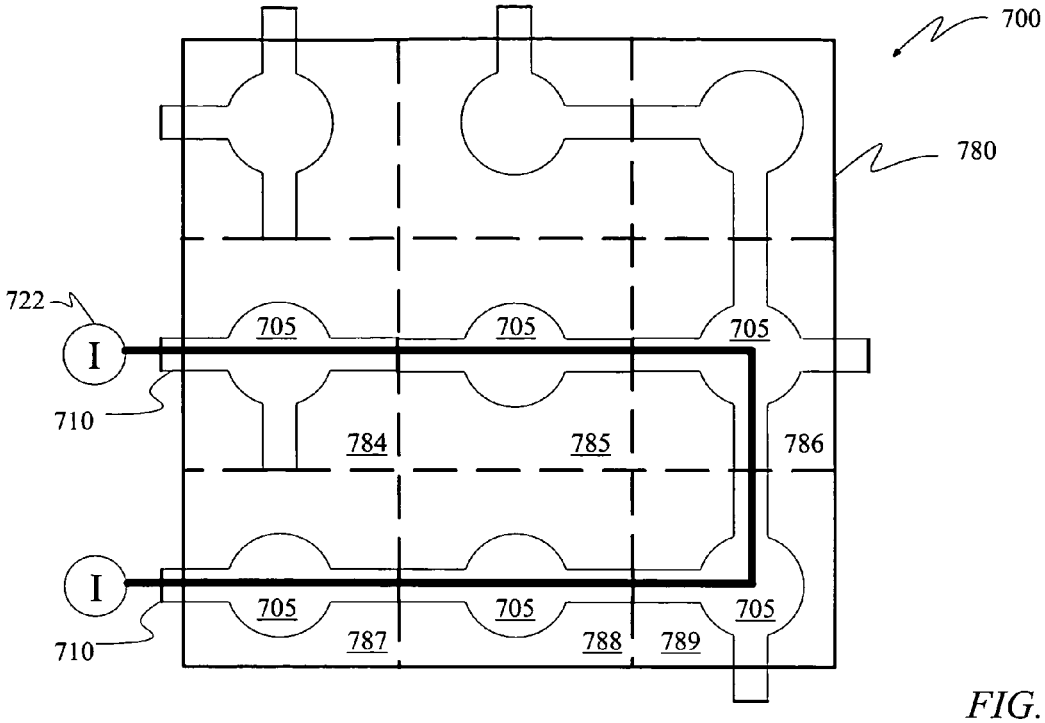
FIG. 7 is an exemplary game outcome illustrating an indicia developed payline entering and exiting the same side of the array.

For example, in FIG. 7, one embodiment of the wagering game 700 is depicted with the randomly selected indicia forming an array 780. The indicia developed payline 722 created by indicia linking together in array positions 784, 785, 786, 789, 788, and 787 enters and exits the same side of the array 780. The indicium in array position 784 includes a member 710 for entering/exiting the array 780, and the indicium in array position in 787 has a member 710 for exiting/entering the array.

Figure 8:
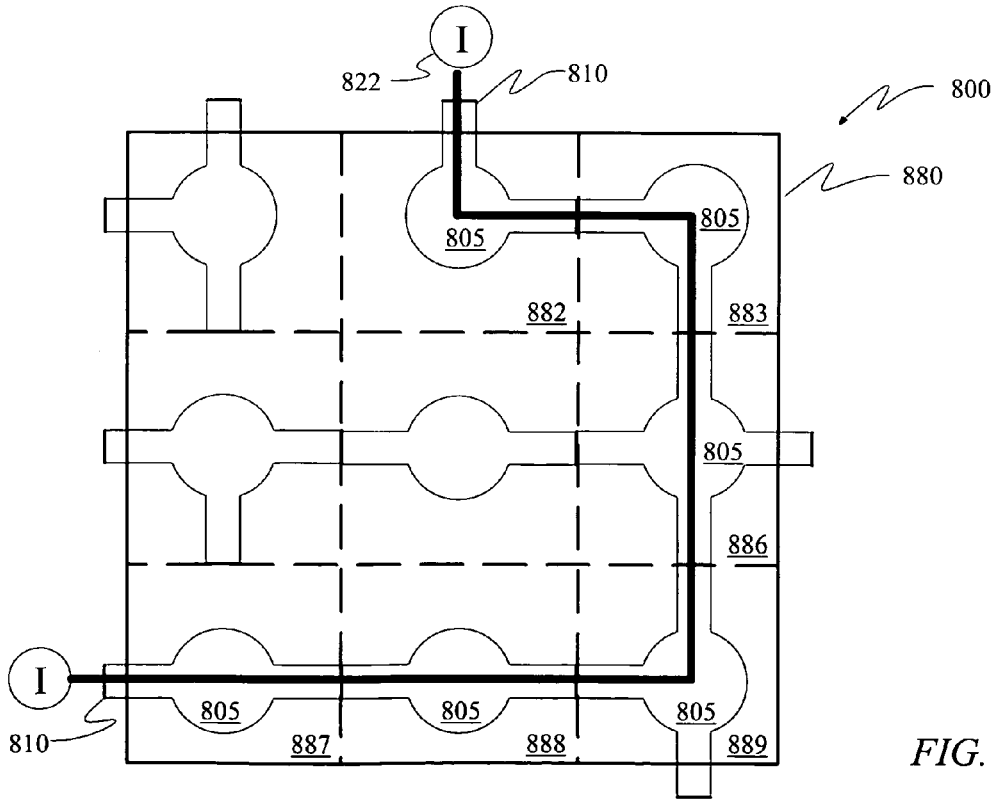
FIG. 8 is an exemplary game outcome illustrating an indicia developed payline entering the side and exiting the top of the array.

Referring to FIG. 8, another non-traditional payline is illustrated in a wagering game 800 having randomly selected indicia forming an array 880. In the embodiment illustrated in FIG. 8, the wagering game 800 has a payline 822 entering the left side of the array 880 and exits at the top of the array 880 through the linked indicia in array positions 887, 888, 889, 886, 883, and 882. The indicium in array position 887 has a member 810 for entering/exiting the array 880, and the indicium in array position 882 has a member 810 for exiting/entering the array.

In the embodiments discussed above, the paylines have an indicium at the start and at the end of the payline having a member entering and exiting the array respectively. In other embodiments, there is no requirement for the payline to have indicia with members entering and exiting the array—the indicia must only have members linking the indicia together.

Figure 9A:
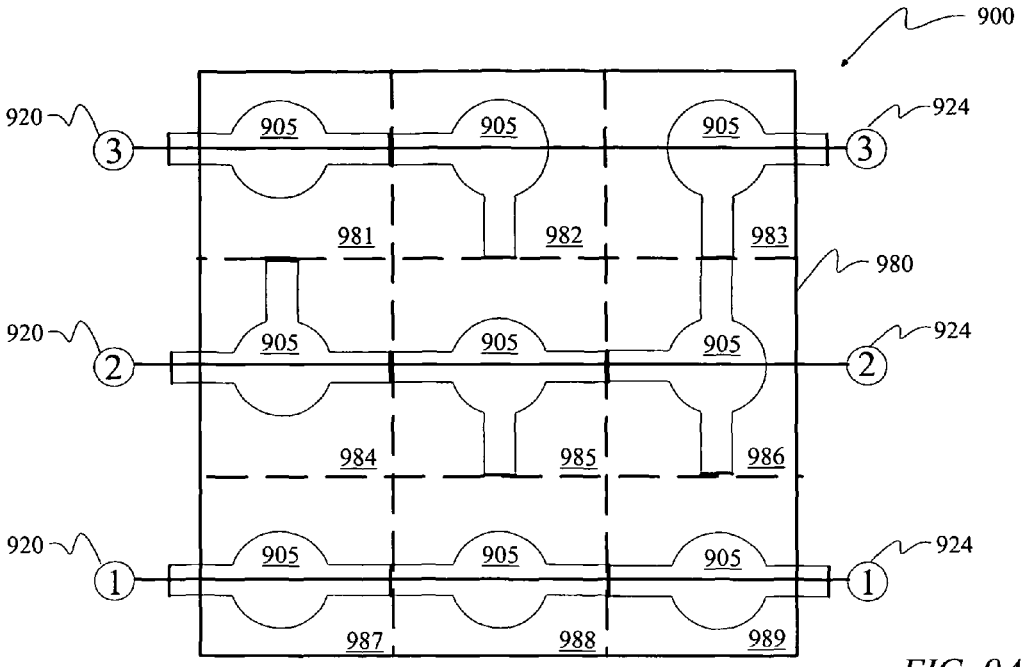
FIG. 9A is an exemplary game outcome for one embodiment of the wagering game having both preset and indicia developed paylines.

Referring to FIG. 9, another embodiment of the wagering game 900 is depicted having an array 980 filled with randomly selected indicia having preset paylines 924. These preset paylines 924 designating predetermined array positions are similar to those on traditional slot type wagering games. The player may wager on the three traditional horizontal preset paylines 924: 1) the first row (array positions 981, 982, and 983); 2) the second row (array positions 984, 985, and 986); and 3) the third row (array positions 987, 988, and 989). In this embodiment, the player makes a wager for each of these three preset paylines 924 and may receive any indicia developed paylines as a bonus for playing the wagering game 900. For simplicity and ease of illustration, the indicia developed payline requirements are the same in this embodiment as for the exemplary embodiment of FIG. 5.

Figure 9B:
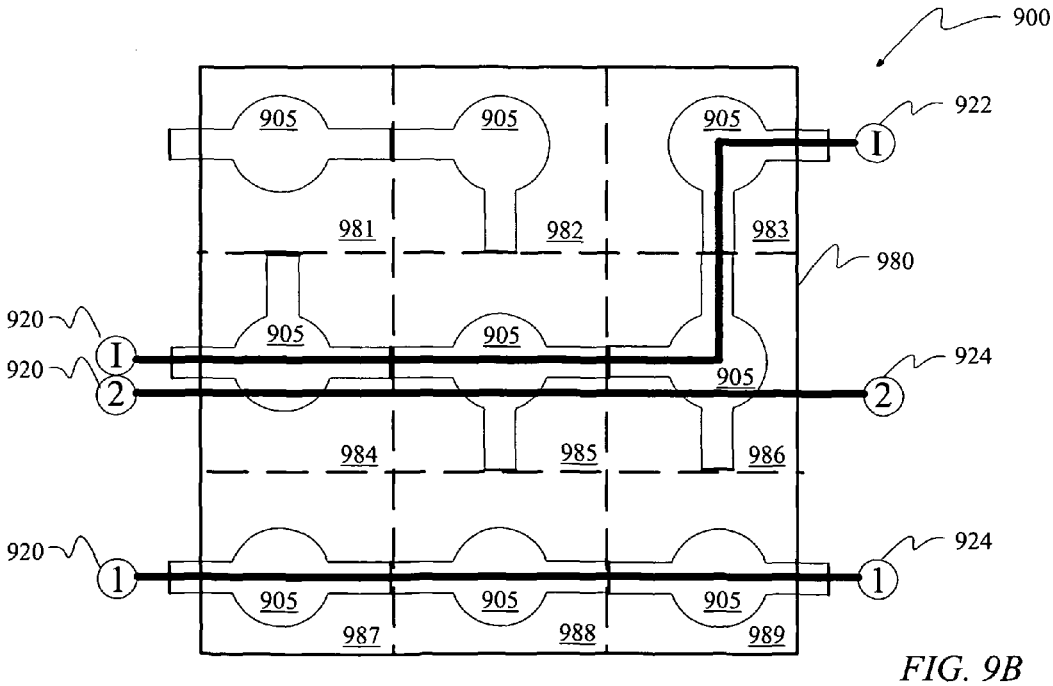
FIG. 9B is the exemplary game outcome of FIG. 9A illustrating a winning indicia developed payline and two winning preset paylines.

Referring to FIG. 9B, the highlighted pay lines designate the winning game outcomes. In this exemplary game outcome, the player has received winning game outcomes on two types of pay lines 920: 1) the preset paylines 924 (array positions 984, 985, 986; and array positions 987, 988, 989); and 2) the indicia developed payline 922 (array positions 984, 985, 986, and 983).

Referring to FIG. 10, another embodiment of an exemplary pay table 1000 is depicted for the wagering game 900 embodiment of FIG. 9. In this exemplary pay table 1000, any payline with three or more indicia of the same type is a winning game outcome as shown by the winning indicia combinations 1010. The indicia developed payline awards 1020 are listed for each of the winning indicia combinations 1010 (note: angular orientation irrelevant to the award). The exemplary pay table 1000 of FIG. 10 also includes preset payline awards 1030 which require three of the same indicia type to receive an award. The preset payline awards 1030 are available in two different types for winning indicia combinations: 1) the same angular orientation award 1032 and 2) different angular orientation award 1034.

Referring back to FIG. 9B, the preset payline 924 designating array positions 984, 985, and 986 includes three indicia of the same type, with different angular orientations. Therefore, referring to FIG. 10, according to pay table 1000 the winning indicia combination 1010 of the three, three-member indicia provides a preset payline award 1030 for indicia with different angular orientations 1032 of two credits.

Referring back to FIG. 9B, the preset payline 924 designating array positions 987, 988, and 989 includes three indicia of the same type in the same angular orientation. Again, referring to FIG. 10, according to the pay table 1000, the winning indicia combination 1010 of three, two-member indicia provides a preset payline award 1030. In this example, because the indicia have the same orientation, the winning indicia combination receives the same angular orientation award 1032 of three credits.

Referring back to FIG. 9B, the indicia developed payline 922 designating array positions 984, 985, 986, and 983 has three indicia of the same type. Referring to FIG. 10, according to the pay table 1000, the winning indicia combination 1010 of three, three-member indicia, provides an indicia developed payline award 1020 of three credits.

Although all the exemplary embodiments described above are indicia with up to four members, other embodiments are possible with indicia having any number of members. For example, in one embodiment indicia with up to eight indicating members may be used in the array. Members are distributed at 45° increments around the indicia in this embodiment. This allows indicia developed paylines to be formed not only in orthogonal (i.e., horizontal and/or vertical directions), but also along diagonal lines in the array.

Alternatively, diagonal paylines may also be developed by allowing up to four member, orthogonal indicia to stop with members at a 45, 135, 225, or a 315 degree angle—rather than limited to 0, 90, 270, and 360 degree angles (which establish orthogonal paylines pay lines as described in the exemplary embodiment of FIG. 5).

In still another embodiment, the indicia may have dual (or more) characteristics. For example, an indicium may have both a plurality of members and an associated symbol. In this embodiment, the members of the indicia form the payline while the symbols on the indicia forming the payline determine a winning game outcome. Such an embodiment is illustrated in FIG. 11.

Figure 11A:
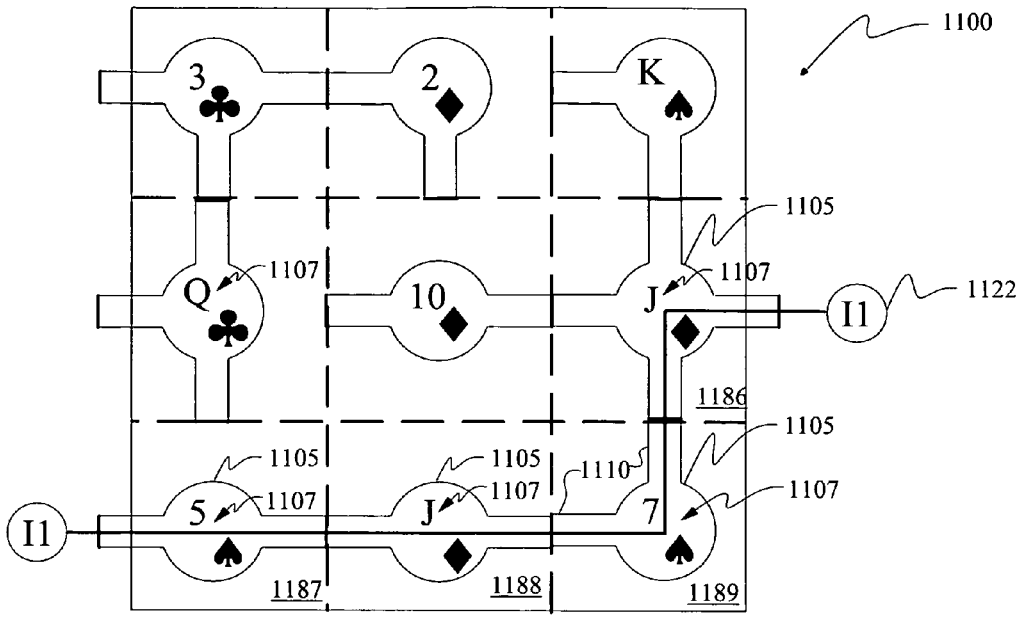
FIG. 11A is an exemplary game outcome for an embodiment of the wagering game having indicia with associated symbols.

Referring to FIG. 11A, the exemplary wagering game 1100 has indicia 1105 with associated symbols 1107. In this embodiment, the indicia 1105 designated by the indicia developed payline 1122 determine the card hand based on the associated symbols 1107 displayed on each of the designated indicia.

The associated symbol 1107 (or symbols) on each indicium 1105 are distinguished from the remainder of the indicium. For example, in array position 1189 the indicium 1105 has two members 1110 and an associated symbol 1107 (the Seven of Spades). Consequently, in this embodiment, the indicia are a combination of a card symbol (e.g., Seven of Spades) to determine a winning game outcome and a number of members 1110 for forming pay lines.

FIG. 11A illustrates an exemplary game outcome with a winning indicia developed payline 1122. In this wagering game embodiment, the same pay line conditions applied to the wagering game embodiment of FIG. 5 have been applied. Consequently, array positions 1187, 1188, 1189, and 1186 form a payline 1122. In this wagering game embodiment, the objective of the game is to form a winning poker hand.

In this wagering game embodiment, similar to the wagering game embodiment illustrated in FIG. 5, the winning game outcomes may comprise between three and five indicia. Consequently, pay tables may be available for 3, 4, and 5-card poker games. In this exemplary outcome, the player has a Pair of Jacks. The award for such a game outcome may be indexed to a pay table for a four-card poker game—based on the four indicia comprising the pay line 1122.

Figure 11B:
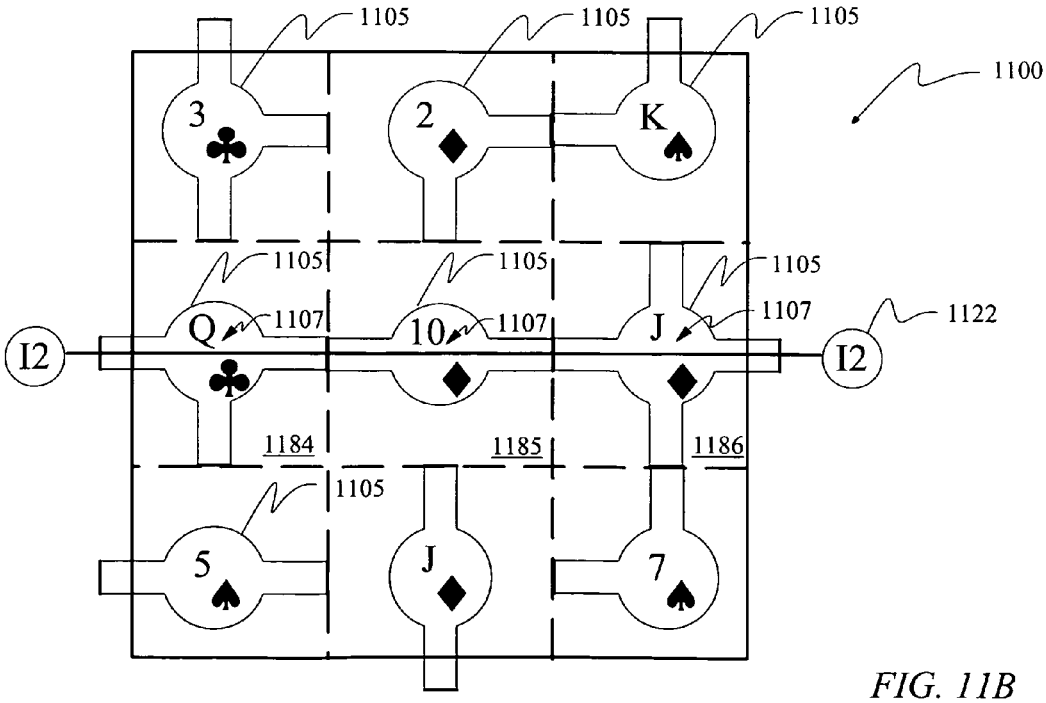
FIG. 11B is an exemplary game outcome received from the random angular reorientation of the indicia in the array depicted in FIG. 11A.

Referring to FIG. 11B, the indicia have been respun while the symbols associated with the indicia remains stationary (for ease of player viewing). As a result of the respin, new pay lines have been created. As can be seen from FIG. 11B, a new indicia developed payline 1122 in array positions 1184, 1185, 1186 has been created. A new winning game outcome has been created on this pay line comprising the symbols: Queen of Clubs, Ten of Diamonds, and Jack of Diamonds. These symbols create a straight in a typical three-card poker game. As similarly discussed above, this three indicia payline could be associated with a three-card pay table which would typically have an award for such a straight.

The wagering games described herein may include a variety of additional game play features. For example, certain indicia may be labeled as wild indicia, allowing that indicia to take on any angular orientation that satisfies the establishment of a winning game outcome. Alternatively, a wild indicium may transform to an indicium having the maximum number of members available for creating linking indicia. For example, a two-member indicium having a wild symbol may transform into a four-member indicium. In still another embodiment, a winning game outcome may cause the indicia on the payline to be removed and replaced with randomly selected indicia—giving the player a second opportunity for another winning game outcome. In addition, the wagering game described herein could also be played as a non-wagering game.

Other embodiments for this wagering game include different graphical methodologies for establishing subsets of indicia in the array. As illustrated in the above embodiments, one graphical methodology to indicate linkage between indicia is to use aligning members that make contact. For example, in one embodiment, members on adjacent indicia may be lengthened and shortened dependent upon the orientation of the member to the adjacent indicia to facilitate the player's comprehension of the display. In another embodiment, the members may only require general alignment (i.e., no contact between members). Other methodologies may also be used to establish a link between indicia.

It should be noted that members of adjacent indicia are not required to contact in order to demonstrate linkage between the indicia—any graphical method may be used to convey the identification of a subset of indicia in the array. In one embodiment any type of indicator associated with the indicium and observable by the player may be used to establish a subset of indicia. The indicator, in one embodiment, itself may be rotated about the indicium. In another embodiment, the indicator may be, for example, a pointer or any other graphical element that conveys to the player a subset of indicia in the array.

While the invention has been illustrated with respect to several specific embodiments, these embodiments are illustrative rather than limiting. Various modifications and additions could be made to each of these embodiments as will be apparent to those skilled in the art. Accordingly, the invention should not be limited by the above description or of the specific embodiments provided as examples. Rather, the invention should be defined only by the following claims.

The invention claimed is:

1. A method of playing a wagering game on a gaming machine, the gaming machine having a processor for executing a game program and presenting the wagering game on a display, comprising:

receiving a wager;

forming an array with indicia assigned to a plurality of array positions, the indicia randomly selected from a plurality of indicia types, each of the indicia types having a different number of members for directionally identifying adjacent indicia in the array;

identifying a subset of indicia in the array, wherein each of the indicia in the subset mutually identify directionally with at least one other of the indicia in the subset;

evaluating the subset of indicia for a winning indicia combination, wherein the winning indicia combination is determined by the number of members on each of the indicia in the subset of indicia; and providing an award for the winning indicia combination.

2. The method of claim 1, wherein all the indicia in the subset of indicia are linked together.

3. The method of claim 1, wherein the subset of indicia includes a first indicium and a last indicium, the first indicium and the last indicium each mutually identify with only one indicium in the subset.

4. The method of claim 3, wherein the first indicium and the last indicium each have at least one member extending from the array.

5. The method of claim 3, wherein none of the indicia in the subset of indicia mutually identify with more than two indicia in the subset.

6. The method of claim 1, wherein the indicia in the array have a randomly determined angular orientation in each of the array positions, the angular orientation of the indicia determining the adjacent indicia identified.

7. The method of claim 6, wherein the angular orientation of the indicia in the array changes before identifying the subset of indicia.

8. The method of claim 6, further including changing the angular orientation of at least some of the indicia in the array to form another subset of indicia.

9. The method of claim 1, wherein the plurality of indicia types include indicia having two, three, and four members.

10. A method of playing a wagering game on a gaming machine, the gaming machine having a processor for executing a game program and presenting the wagering game on a display, comprising:

receiving a wager;

forming an array with indicia assigned to a plurality of array positions, the indicia selected from a plurality of indicia types, each of the indicia types having a different number of members for directionally identifying adjacent indicia in the array;

identifying a subset of indicia in the array, the subset of indicia including a first indicium and a last indicium, wherein the first indicium and the last indicium each mutually identify directionally with only one indicium in the subset, and further wherein none of the indicia in the subset mutually identify directionally with more than two indicia in the subset;

identifying a payline through the subset of indicia, wherein the first indicium and the last indicium each have at least one member extending from the array;

evaluating the subset of indicia identified by the payline for a winning indicia combination, wherein the winning indicia combination is determined by the number of members on each of the indicia identified by the payline; and providing an award for a winning indicia combination.

11. The method of claim 10, wherein at least one of the indicia types further include indicia having the same number of members in different geometric configurations.

12. The method of claim 10, wherein the indicia in the array have a randomly determined angular orientation in each of the array positions, the angular orientation of the indicia determining the adjacent indicia identified.

13. The method of claim 12, wherein the angular orientation of the indicia in the array changes before indentifying the subset of indicia.

14. The method of claim 12, further including changing the angular orientation of at least some of the indicia in the array after identifying the subset of indicia.

15. A gaming machine for playing a wagering game, comprising:

a wager acceptor for recognizing a wager;

a video display for displaying the wagering game;

a processor configured for executing a game program to:

form an array with indicia assigned to a plurality of array positions, the indicia randomly selected from a plurality of indicia types, each of the indicia types having a different number of members to directionally identify adjacent indicia in the array;

identify a subset of indicia in the array, wherein each of the indicia in the subset mutually identify directionally with at least one other of the indicia in the subset;

evaluate the subset of indicia for a winning indicia combination, wherein the winning indicia combination is determined by the number of members on each of the indicia in the subset of indicia; and a payout mechanism for providing an award for the winning indicia combination.

16. The gaming machine of claim 15, wherein all the indicia in the subset of indicia are linked together.

17. The gaming machine of claim 15, wherein the subset of indicia includes a first indicium and a last indicium, the first indicium and the last indicium each mutually identify with only one indicium in the subset.

18. The gaming machine of claim 17, wherein the first indicium and the last indicium each have at least one member extending from the array.

19. The gaming machine of claim 17, wherein none of the indicia in the subset of indicia mutually identify with more than two indicia in the subset.

20. The gaming machine of claim 15, wherein the indicia types have two, three, and four members.

* * * * *